United States Patent [19]

Braun

[11] Patent Number: 4,705,460

[45] Date of Patent: Nov. 10, 1987

[54] BOUNCE CHAMBERS FOR MULTI-CYLINDER LINEAR ENGINE COMPRESSORS

[76] Inventor: Anton Braun, 6421 Warren Ave. So., Minneapolis, Minn. 55435

[21] Appl. No.: 705,716

[22] Filed: Feb. 26, 1985

[51] Int. Cl.[4] ..... F02B 71/00

[52] U.S. Cl. ..... 417/266; 417/364; 417/380; 123/465 C

[58] Field of Search ..... 417/364, 380, 264, 266; 123/465 C; 92/9, 10, 143

[56] References Cited

U.S. PATENT DOCUMENTS

| | | | |
|---|---|---|---|
| 2,241,957 | 5/1941 | Pescara . | |
| 3,044,452 | 7/1962 | McCrory et al. | 123/465 C |
| 3,176,801 | 4/1965 | Huff | 92/9 X |
| 3,190,545 | 6/1965 | Weber et al. | 417/266 X |
| 3,200,249 | 8/1965 | Janicke . | |
| 3,461,806 | 8/1969 | Barthalon | 92/10 X |
| 3,853,100 | 12/1974 | Braun | 123/465 C |
| 4,353,220 | 10/1982 | Curwen et al. | 417/418 |

FOREIGN PATENT DOCUMENTS

| | | | |
|---|---|---|---|
| 637527 | 10/1936 | Fed. Rep. of Germany | 417/266 |

*Primary Examiner*—Carlton R. Croyle
*Assistant Examiner*—Ted Olds
*Attorney, Agent, or Firm*—Alan M. Staubly

[57] ABSTRACT

This invention is a multi-stage compressor embodying a stepped piston in a stepped cylinder and connected through a coaxial rod to the piston of an engine. Control means in a passageway or a conduit extending from the second or third stage discharge of the compressor or any other source of pressure to a single bounce chamber, responds to pressure in the bounce chamber to increase or reduce gas pressure in the chamber, to balance the energy and work quantities acting in opposite directions to provide optimimum operation of the compressor at varying pressures.

12 Claims, 7 Drawing Figures

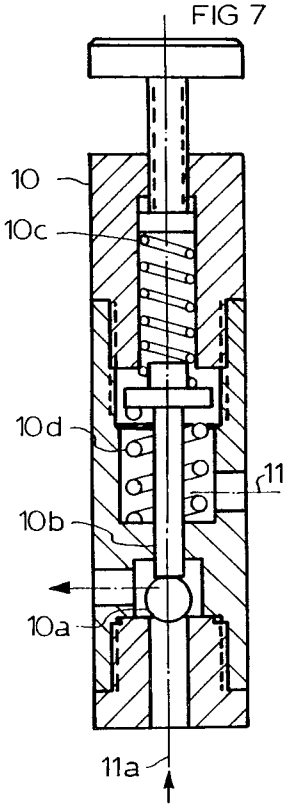
FIG 7
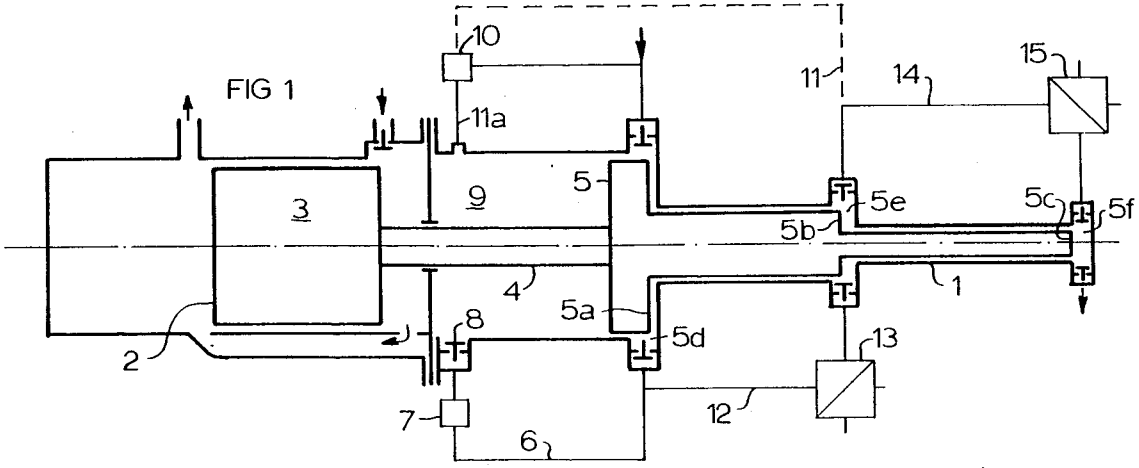
FIG 1
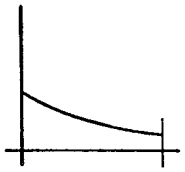
FIG 3
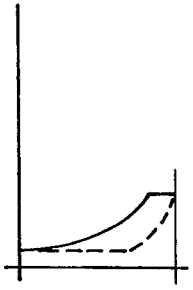
FIG 4
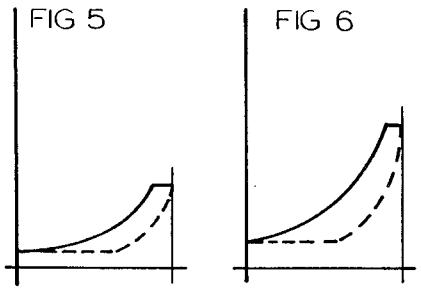
FIG 5
FIG 6
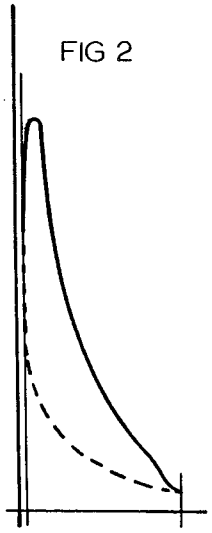
FIG 2

BOUNCE CHAMBERS FOR MULTI-CYLINDER LINEAR ENGINE COMPRESSORS

This invention is concerned with a multi-stage engine compressor of the free floating piston type for the compression of gases. In certain applications, such compressors are used to compress gas from a varying pressure on the suction side of the compressor through several compression stages to a substantially varying discharge pressure. In a three stage compressor, the suction pressure may vary between 15 psia and 30 psia while the discharge pressure varies between 2000 psia and 3600 psia which requires the compression section to work with compression ratios from as low as 67:1 to as high as 240:1. This may result in substantial differences in the energy balance between the engine section and the compressor section and in the work balance between the power stroke and the return stroke of the engine compressor assembly.

This problem of balancing these energy and work quantities is considerably aggrevated by the fact that the compression work done on the first stage compressor may vary at a substantially different rate than that of the second and any subsequent stages under the varying intake and discharge pressures.

In addition to these specific problems there are the basic problems of multi-stage compressors, whether they be of the free fluctuating piston or of the crank driven type, of arranging the compressor piston faces in such a way that the maximum gas forces are keptto a minimum. In the crank driven compressor one or more stages are often divided into two and the vectoral sum of the products of the piston faces and their respective maximum pressures are arranged to be zero to keep maximum stresses and maximum bearing loads of the machine to a minimum. In compressors of the free floating piston type the balance of the forces and related work quantities which are done on or by the piston can be more important than their absolute value in that a given work balance is greatly affected by the choice and location of the individual piston faces. This may result in excessive pressures in the bounce chamber of such a machine or require more than one bounce chamber or even requiremore than one engine/compressor piston assembly, for such an engine/compressor to operate satisfactorily throughout its entire pressure and load range and preferably for a number of different gases.

To deal with these complex problems many different solutions have been proposed. In U.S. Pat. No. 2,241,957, for instance, it is proposed to provide two separate oppositely moving motor or engine piston assemblies one of which carries an energy accumulator or balancing piston and the other carries all the compressor pistons whose non-active faces (back faces), of which at least one is subjected to a pressure higher than atmospheric pressure, act as additional energy accumulators, each providing the balancing work of it's corresponding compressor section.

The chief object of the present invention is to provide a compact and strong multi-stage engine compressor with a minimum number of parts and adapted to operate through a wide range of operating conditions and suitable for a number of different applications without having to change its major components. Only one engine piston is needed in this compressor.

It is a more specific object of the present invention to provide a multi-stage engine compressor of the free piston type requiring a smaller number of parts and of smaller than usual size and adapted to keep the engine or power section at near optimum operating conditions during substantially varying suction and discharge pressures and pressure ratios.

Still another object of the present invention is to provide an engine that operates at near optimum conditions during a part load condition.

A further object of the invention is to provide a compressor that does not require a narrow configuration of piston and cylinder design to meet various sets of conditions or applications but requires merely slight changes in the control elements, such as the diameter of a little control piston and/or spring.

The above and other objects of the invention will become apparent upon reading the following description of the preferred embodiment of the invention wherein:

FIG. 1 is a schematic showing of the invention;

FIGS. 2 thru 6 are force-stroke diagrams of the engine section, the bounce section, the first compression section, the second compression section and the third compression section; and FIG. 7 is an enlarged view of the control device connected to a negative bounce chamber.

To obtain the chief objective, a housing 1 and a single reciprocally moveable piston assembly 2 is provided carrying both the engine or power piston 3 and directly interconnected by a piston rod 4 to a single compressor piston assembly 5 of the stepped piston type.

In the preferred embodiment of the invention, all compressor stages of the stepped piston compressor are single acting and act in the same direction and the only back face of the compressor piston assembly that is acting, is in the only accumulator or bouncer section and is preferably that of the first stage compressor piston. It acts in the opposite direction to provide the work balance during both the power and the return stroke, which is necessary to have the engine or power section operate at or near its optimum operating conditions.

In FIG. 1, a schematic three stage engine compressor, the preferred embodiment, is shown. In FIGS. 2 thru 6 the force-stroke diagrams of respectively the engine section, the bouncer and the three compression stages are shown, representing, by the areas under their respective curves, the relative work of each section during both the power and the return stroke, friction work and scavenge work having for claritys sake been neglected. The work for each section during the return stroke is represented by the areas under the dotted lines while the work for each section during the power stroke is represented by the areas under the solid lines. For the desired operation of the engine compressor the engine or power section has to operate with a certain compression ratio, determining the position of its left ordinate, the right ordinate being determined by the desired fuel input into the engine and the suction and discharge pressures of the compressor, the equality of the power and the return stroke being obtained by providing the appropriate pressure in the balancing or bouncer section, whose absolute work during the power and return strokes is essentially equal.

This appropriate bounce pressure during the return stroke of the piston assembly must result in the area under the solid line of the FIG. 3 diagram being equal to the difference of the sum of the areas under the dotted lines of the diagrams in FIGS. 4, 5, and 6 and of the area under the dotted line of of the FIG. 2. Similarly, during the power stroke of the piston assembly and during steady state operation of the engine compressor, the same area under the solid line of the bouncer pressure diagram in FIG. 3 must and will be equal to the difference of the area under the solid line of the FIG. 2 diagram and of the sum of the areas under the solid lines of the diagrams in FIGS. 4, 5 and 6.

For different gases and different suction and discharge pressure levels and pressure ratio and part load requirements as well as for different numbers of stages of the engine compressor the appropriate bounce pressure may be supplied in a different fashion and from different sections or even from the atmosphere. Similarly, to obtain the most desired results, the relative piston diameters and compressor clearance volumes may be selected so as to obtain the most desired overall characteristics.

One such engine compressor is shown in the accompanying photograph of the invention for the compression of natural gas from suction pressures varying between approximately 15 psia and 30 psia to discharge pressure, varying between approximately 2000 psia and 3600 psia, for the charging of compressed natural gas (CNG) cylinders for use in vehicles operating on natural gas as a fuel. It is possible to run such an engine compressor throughout the above pressure ranges at an essentially constant and optimum engine compression ratio and with the maximum bouncer pressure in the bounce chamber remaining within very close range of the first stage discharge pressure, which is a very efficient condition similar to that in a double-acting compressor stage. These desirable results were obtained with the rather simple control system shown in FIGS. 1 & 7 in which a small control flow of gas through a conduit or passageway 6 from the first stage discharge side is bled through an orifice unit 7 and check valve 8 into a negative bounce chamber 9, the maximum pressure in the bounce chamber being maintained through a control device 10 which is operated by gas from a gas pressure source, such as the discharge side of the second stage through conduit 11 and, if desired, may bleed the excess control gas to the atmosphere or into the suction or inlet line or conduit to chamber 5*d*. A valve 10*a* responds to the difference between the pressure in bounce chamber 9 and the discharge pressure of the second compression stage in lines 11 and 14 to increase the pressure in the bounce chamber with increasing pressure in line 11 and reduce it as the pressure in line 11 goes down.

In operation, when the engine drives piston 3 to the right hand position as shown in FIG. 1, piston 5*a* forces gas from chamber 5*d*, past an outlet check valve, throughline 6, orifice member 7 and check valve 8 into bounce chamber 9 and through a branch line 12, a gas cooler 13 and an inlet check valve into a second stage compressor chamber 5*e*. Simultaneously, gas is driven from chamber 5*e* past an outlet check valve, and through line 11 to controller device 10. This control 10 in FIG. 7 has a valve 10*a* that determines the maximum pressure in the negative bounce chamber 9 automatically depending on the 2nd stage discharge pressure, thereby increasing the negative bounce pressure as the 2nd stage pressure increases and visa-versa. The two springs 10*d* and 10*c* may be adjusted to allow the device to increase or decrease the bias of the pressure balance in the compressor. Also simultaneously, gas flows from chamber 5*e* through a branch line 14 and gas cooler 15 to the third stage compression chamber 5*f*.

The nominal flow of one 3-stage engine compressor model built according to the present invention is between 20 and 35 scfm at a safe speed of only approximately 1000 cycles per minute depending on whether the engine is carbureted or fuel injected, and the dimensions of the machine are 18"×20"×80" inches and its weight approximately 600–700 lbs. The energy consumption to compress the natural gas of the machine is in the order of 30% below that of the most widely used and commercially available units and its cost is substantially less. Comparable free piston engines of only single-stage type are substantially more complex and at least 3 times the weight and of much higher manufacturing cost. A three stage compressor of this type would be of greater weight and cost.

While the invention described above and shown in the attached photograph has proven, through testing, to be a practical, robust, cost effective and efficient compressor it should be well understood that changes in the arrangement, disposition and form of the parts may be made without departing from the principles comprehended within the scope of the appended claims. In particular, the engine compressor may be equiped with a balancing mechanisms as e.g. illustrated in my U.S. Pat. No. 3,853,100 and utilized in FIG. 3 of the patent or include other elements without detracting from the spirit of the invention.

I claim:

1. A bounce chamber combination for use in a free piston internal combustion engine driven multi-stage compressor comprising a plurality of coaxial compressor pistons in a plurality of compressor cylinders providing at least first and second stage gas pressure chambers, means providing a controlled and limited but constant gas flow from one of said pressure chambers to a negative bounce chamber in one of said cylinders, a gas flow passageway between a source of different gas pressure generated by the operation of the compressor and control means arranged to variably control gas flow out of said bounce chamber in response to variations in the pressure in said source of different gas pressure.

2. A bounce chamber combination as defined in claim 1 wherein said control means also variably responds to varying pressure in said bounce chamber.

3. A bounce chamber combination as defined in claim 1 wherein said bounce chamber is on the opposite side of the first stage compressor piston from said first stage pressure chamber.

4. A bounce chamber combination as defined in claim 1 wherein said compressor has more than two stages of compressor chambers and pistons.

5. A bounce chamber combination as defined in claim 1 wherein said control means is a valve that is spring biased in opposition to gas pressure from said source.

6. A bounce chamber combination as defined in claim 4 wherein all compressor pistons are directly connected to a piston in said engine.

7. A bounce chamber combination as defined in claim 5 wherein there are more than two stages of compressor cylinders and pistons.

8. A bounce chamber combination as defined in claim 4 wherein said source of gas pressure is one of the second or additional compressor pressure chambers.

9. A bounce chamber combination as defined in claim 1 wherein there is a bleed line from said bounce chamber controlled by said control means and said engine is one having a single power stroke.

10. A bounce chamber combination as defined in claim 1 wherein there is only one bounce chamber.

11. In a multi-stage compressor capable of being connected to a power source comprising a piston rod for connecting the compressor to the power source at one end and at the other end to a stepped piston having at least three piston portions of different diameters with at least two thereof being single-faced pistons and only the piston portion of the largest diameter is double-faced and wherein all of the single-faced pistons and one face of the double-faced piston are utilized as single-acting compressor pistons and the other face of the double-faced piston is used as a bouncer piston surface, means providing a controlled and constant and limited gas flow connection between gas chambers on opposite sides of said double-faced piston, and means to control gas flow out of the chamber having said other face.

12. The combination as defined in claim 11 and in which all compressor stages are performing their compression and discharge work during a single power stroke of the power source.

* * * * *